US008876431B1

(12) United States Patent
Becker et al.

(10) Patent No.: US 8,876,431 B1
(45) Date of Patent: Nov. 4, 2014

(54) SUBMERSIBLE BULKHEAD SYSTEM AND METHOD OF OPERATING SAME

(71) Applicant: J.F. Brennan Co., Inc., La Crosse, WI (US)

(72) Inventors: Steven D. Becker, Buffalo City, WI (US); Daniel C. Wibralski, Sparta, WI (US); Michael A. McCullick, Stoddard, WI (US)

(73) Assignee: J.F. Brennan Co., Inc., La Crosse, WI (US)

( * ) Notice: Subject to any disclaimer, the term of this patent is extended or adjusted under 35 U.S.C. 154(b) by 61 days.

(21) Appl. No.: 13/780,937

(22) Filed: Feb. 28, 2013

Related U.S. Application Data

(60) Provisional application No. 61/604,734, filed on Feb. 29, 2012.

(51) Int. Cl.
*E02B 7/14* (2006.01)
*E02B 7/04* (2006.01)

(52) U.S. Cl.
CPC ..... *E02B 7/04* (2013.01)
USPC ..... 405/111

(58) Field of Classification Search
USPC ..... 405/107, 110, 111, 112
See application file for complete search history.

(56) References Cited

U.S. PATENT DOCUMENTS

| | | | |
|---|---|---|---|
| 249,024 | A | 11/1881 | Dechant |
| 1,567,715 | A | 12/1925 | De Witt |
| 1,858,664 | A | 5/1932 | Friedel |
| 1,918,015 | A | 7/1933 | Broome |
| 2,055,512 | A | 9/1936 | Wallace |
| 2,385,341 | A | 9/1945 | Bayley |
| 2,683,354 | A | 7/1954 | Harza |
| 4,439,061 | A | 3/1984 | Whipps |

(Continued)

FOREIGN PATENT DOCUMENTS

| | | |
|---|---|---|
| EP | 0163292 B1 | 12/1985 |
| JP | 62156413 | 7/1987 |

OTHER PUBLICATIONS

Floating Bulkhead Gates, webpage of Steel-Fab, Inc., retrieved from url: http://web.archive.org/web/20100117193750/ http://www.steel-fab-inc.com/gates-floatingbulkhead.html. dated (according to the Internet Archive "Wayback Machine") Jan. 17, 2010, 1 page.

(Continued)

*Primary Examiner* — Benjamin Fiorello
*Assistant Examiner* — Kyle Armstrong
(74) *Attorney, Agent, or Firm* — Whyte Hirschboeck Dudek S.C.

(57) ABSTRACT

A bulkhead system and a method of implementing such a bulkhead system in relation to a dam are disclosed herein. In one example embodiment, such a method includes providing a plurality of bulkhead sections assembled together as a bulkhead assembly, and coupling first and second side assemblies to first and second ends of the bulkhead assembly. Further, the method includes causing a first of the bulkhead sections to receive a respective amount of ballast within an internal cavity therewithin, receiving water pressure at an upstream surface of the bulkhead assembly such that the bulkhead system is forced against the dam and substantially sealed in relation thereto, and operating to counteract the water pressure and thereby prevent or limit the flow of water past the dam, where the operating is performed at least in part by one or more brace members of the side assemblies.

20 Claims, 9 Drawing Sheets

(56) References Cited

U.S. PATENT DOCUMENTS

| | | | |
|---|---|---|---|
| 4,661,014 | A | 4/1987 | Aubert |
| 4,729,692 | A | 3/1988 | Tucker |
| 5,032,038 | A | 7/1991 | Lemperiere |
| 5,118,217 | A | 6/1992 | Younes |
| 5,195,846 | A | 3/1993 | Lemperiere |
| 5,634,742 | A | 6/1997 | Mills |
| 5,642,963 | A | 7/1997 | Obermeyer |
| 6,004,067 | A | 12/1999 | Peppard |
| 6,012,872 | A | 1/2000 | Perry et al. |
| 6,450,733 | B1 | 9/2002 | Krill et al. |
| 7,214,003 | B1 | 5/2007 | Lux, III |
| 7,690,865 | B1 | 4/2010 | Stewart et al. |
| 7,815,397 | B1 | 10/2010 | Dung |
| 8,066,449 | B2 | 11/2011 | Lux, III |
| 2003/0082007 | A1 | 5/2003 | Liou |
| 2008/0008529 | A1 | 1/2008 | Lux, III |
| 2009/0252557 | A1* | 10/2009 | Fisher ..... 405/107 |

OTHER PUBLICATIONS

Schematic Drawing sent from J.F. Brennan, Inc to Robishaw Engineering, Inc. on Apr. 20, 2010, 1 page.

Working Drawing from Robishaw Engineering, Inc. for Flexifloat S-50 Quadrafloat, dated Nov. 8, 1996, 1 page.

Working Drawing from Robishaw Engineering, Inc. for Design Loads S-50 Series Connector System, dated Feb. 25, 2002, 1 page.

* cited by examiner

SUBMERSIBLE BULKHEAD SYSTEM AND METHOD OF OPERATING SAME

CROSS-REFERENCE TO RELATED APPLICATIONS

The present Application claims the benefit of U.S. provisional patent application No. 61/604,734 filed on Feb. 29, 2012 and entitled "Submersible Bulkhead System and Method of Operating Same", which is hereby incorporated by reference herein.

FIELD OF THE INVENTION

The present invention relates to systems and methods for facilitating accessing of lock and/or dam gate assemblies and related components (including, for example, tainter gates) for purposes of allowing installation, replacement, repairing, or other actions to be taken in relation thereto, and more particularly relates to bulkhead systems (including components and arrangements thereof) and related methods for achieving one or more of such objectives.

BACKGROUND OF THE INVENTION

It is often desired that installation, replacement, repairing, and/or other actions be performed in relation to tainter and other lock and dam-type gate assemblies and related components. In some circumstances, it is desired that such actions be performed even though it is not possible or not desirable (due to cost concerns, etc.) for the water typically present around such lock and dam-type gate assemblies to be diverted and drained away from those gate assemblies and related components. It is known that, in at least some such circumstances, the desired actions to be performed in relation to a gate assembly (or associated components) can be performed even though water is still present at or near the upstream end of the gate assembly, by providing a blocking structure or "bulkhead" (or bulkhead structure) at or near the upstream end of those gate assemblies. By providing such a bulkhead structure, even though the water is present at or near the upstream end of the gate assembly, the water is dammed tip and prevented from flowing downstream of the bulkhead structure, and thus downstream portions or components of the gate assembly become dry and accessible so that the desired actions can be taken in relation to those downstream portions or components.

Notwithstanding the potential effectiveness of utilizing bulkhead systems in at least some such circumstances, conventional bulkhead systems are often cumbersome and/or difficult to implement, and/or costly to utilize. Therefore, it would be desirable to provide an improved bulkhead system and/or method that could be developed that would facilitate the performing of installation, replacement, repairing, and/or other actions in relation to gate assemblies and/or associated components in manner(s) that were enhanced relative to conventional bulkhead systems in terms of ease of use or implementation, cost, and/or one or more other considerations.

SUMMARY OF THE INVENTION

In at least one example embodiment, the present invention relates to a bulkhead system for preventing or limiting water flow. The bulkhead system includes a bulkhead assembly having a first end and a second end, the bulkhead assembly including first and second bulkhead sections that each extend between the first and second ends, that are positioned adjacent to one another along a horizontal or substantially horizontal interface surface, and that are arranged so that the first bulkhead section is positioned vertically above the second bulkhead section. Each of the first and second bulkhead sections includes a respective cavity that is configured to receive ballast, the bulkhead sections being capable of varying degrees of floatation or submerging depending upon amounts of the ballast that are received in the cavities. The bulkhead system also includes first and second side assemblies that are respectively positioned adjacent to the first and second ends of the bulkhead assembly and that are configured respectively to span respective distances outward from the respective first and second ends so that the overall bulkhead system will extend fully between opposed side structures of a dam when implemented in relation thereto. Each of the side assemblies includes a respective first structural member that extends outward away from the bulkhead assembly from a respective first location along the respective end of the bulkhead assembly adjacent to which the respective side assembly is positioned, and also each of the side assemblies includes a respective brace member that extends outward away from a respective second location along the bulkhead assembly adjacent to which the respective side assembly is positioned, up to a respective further location along the respective first structural member of the respective side assembly. The bulkhead system further includes a plurality of seal structures configured to establish a watertight or substantially watertight interfacing of the bulkhead system with respect to the dam when implemented in relation thereto.

In at least one additional example embodiment, the present invention relates to a method of implementing a bulkhead system in relation to a dam so as to prevent or limit a flow of water past the dam. The method includes providing a plurality of bulkhead sections assembled together as a bulkhead assembly, where each of the bulkhead sections includes a respective internal cavity that is configured to receive a respective amount of ballast therewithin, and coupling first and second side assemblies to first and second ends of the bulkhead assembly so as to form the bulkhead system. The method also includes causing a first of the bulkhead sections to receive the respective amount of ballast therewithin, receiving water pressure at an upstream surface of the bulkhead assembly such that the bulkhead system is forced against the dam and substantially sealed in relation thereto, and operating to counteract the water pressure and thereby prevent or limit the flow of water past the dam, where the operating is performed at least in part by one or more brace members of the side assemblies of the bulkhead system.

In at least one further example embodiment, the present invention relates to a method of implementing a bulkhead system in relation to a dam so as to prevent or limit a flow of water past the dam. The method includes assembling a plurality of bulkhead sections together as a bulkhead assembly, where each of the bulkhead sections includes a respective internal cavity that is configured to receive a respective amount of ballast therewithin, and further assembling first and second side assemblies to first and second ends of the bulkhead assembly and to one another so as to form the bulkhead system, where the further assembling of the side assemblies to one another includes coupling the side assemblies by way of one or more rods. Additionally, the method includes floating the bulkhead system to a first location proximate the dam, causing a first of the bulkhead sections to receive the respective amount of ballast therewithin so as to result in tipping of the bulkhead assembly as the first bulkhead section becomes increasingly submerged relative to a remainder of the bulkhead assembly, and additionally causing a second of the bulkhead sections to receive the respective amount of ballast therewithin so as to result in further submerging of the bulkhead assembly. The method further includes receiving water pressure at an upstream surface of the bulkhead assembly such that the bulkhead system is forced against the dam and substantially sealed in relation thereto, and operating to counteract the water pressure and thereby prevent or limit the flow of water past the dam, where the operating is performed at least in part by one or more brace members of the side assemblies of the bulkhead system.

Notwithstanding the above examples, the present invention is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. In the drawings.

DETAILED DESCRIPTION

FIGS. 1-1H and 2-2E show various views of portions of an example version of a sectional barge submersible bulkhead system 100, alone and in combination with structural portions of a dam 2 (e.g., piers and concrete monolith) in relation to which the bulkhead system can be implemented. The bulkhead system 100 when mounted in relation to the structural portions of the dam 2 (e.g., between the piers and in contact with the concrete monolith) serves to block water flow and thereby serves as a "dewatering bulkhead system" by which the region of the waterway immediately downstream of the bulkhead system eventually becomes dry or substantially dry so that any of a variety of actions (including for example, installation, replacement, repairing or other work actions) can be performed in that region. Thus, use of the bulkhead system 100 among other things allows work to be done on gates such as tainter gates downstream of the bulkhead system. As will be seen, the bulkhead system 100 can also be considered a modular bulkhead system (or submersible modular bulkhead system) since, in any given embodiment, multiple barges or bulkhead sections or components (modules) can be assembled together to form an overall bulkhead portion, assembly, or structure positioned between the piers albeit, in alternate embodiments, the bulkhead system only includes a single bulkhead component.

Figure 1:
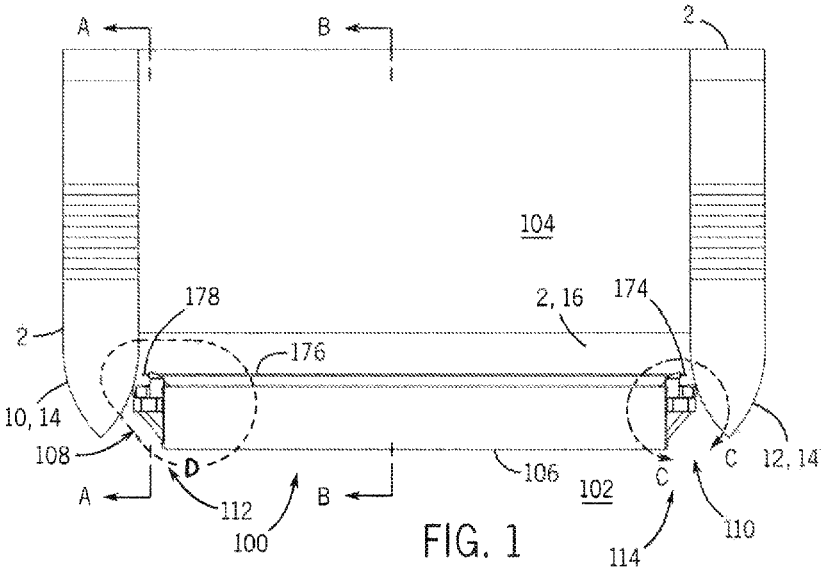
FIG. 1 shows a top plan view of an example sectional barge submersible bulkhead system employed in relation to structural portions (e.g., two piers and a concrete monolith) of a dam.

Referring to FIG. 1, there is provided a top plan view of the sectional barge submersible bulkhead system 100 shown implemented in relation to first and second piers 10 and 12, respectively, of the dam 2, as well as in relation to a concrete monolith 16 extending between those piers and forming a base portion of the dam. More particularly, the bulkhead system 100 is positioned proximate upstream ends 14 of the piers 10, 12 as well as against an upstream surface of the concrete monolith 16 extending between those piers, which is positioned underneath the water line and is shown more clearly in FIGS. 1A-1B. When the bulkhead system 100 is implemented in this manner in relation to the dam 2, water of a waterway in which the dam is situated remains at a region 102 upstream of the bulkhead system 100 but drains away from a region 104 downstream of the bulkhead system (this downstream region includes the region at which the concrete monolith 16 is located, downstream of the bulkhead system).

As shown in FIG. 1 and described in further detail below, the bulkhead system 100 includes both a bulkhead assembly 106 as well as first and second side assemblies 108 and 110 (which can also be considered side extensions), respectively, where the first side assembly 108 is positioned between a first end surface 112 of the bulkhead assembly 106 and the first pier 10 and the second side assembly 110 is positioned between a second end surface 114 of the bulkhead assembly 106 and the second pier 12. Various additional views of the side assemblies 108, 110 alone or in relation to the bulkhead assembly 106 and the dam 2 are provided particularly in FIGS. 1C, 1D and 2-2E, as discussed in further detail below. Additionally, FIG. 1E; provides a front view (that is a view from the upstream side) of the bulkhead system 100 in relation to the first and second piers 10, 12 and the monolith 16 of the dam 2, FIG. 1F provides a front perspective view of these structures, FIG. 1G provides rear view (that is a view from the downstream side) of the bulkhead system 100 in relation to the dam 2, and FIG. 1H provides an additional detail section of a portion of the rear view shown in FIG. 1G.

Figure 1A:
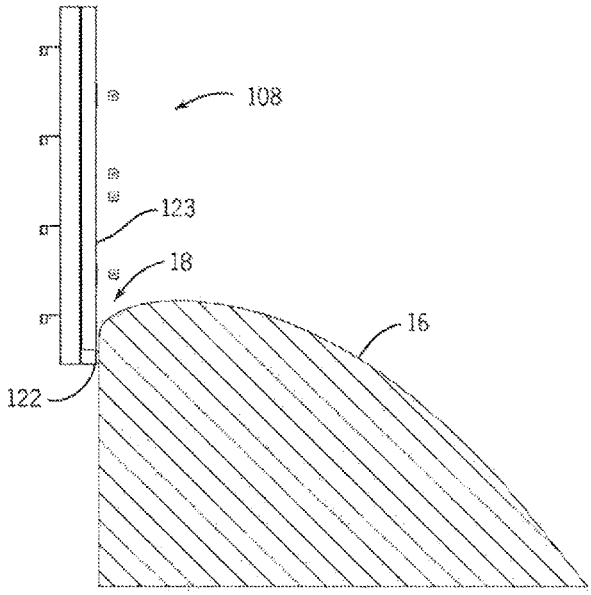
FIGS. 1A and 1B are first and second cross-sectional views, respectively, of the submersible bulkhead system and dam (particularly the concrete monolith thereof) of FIG. 1, taken respectively along line A-A and line B-B thereof.
Figure 1C:
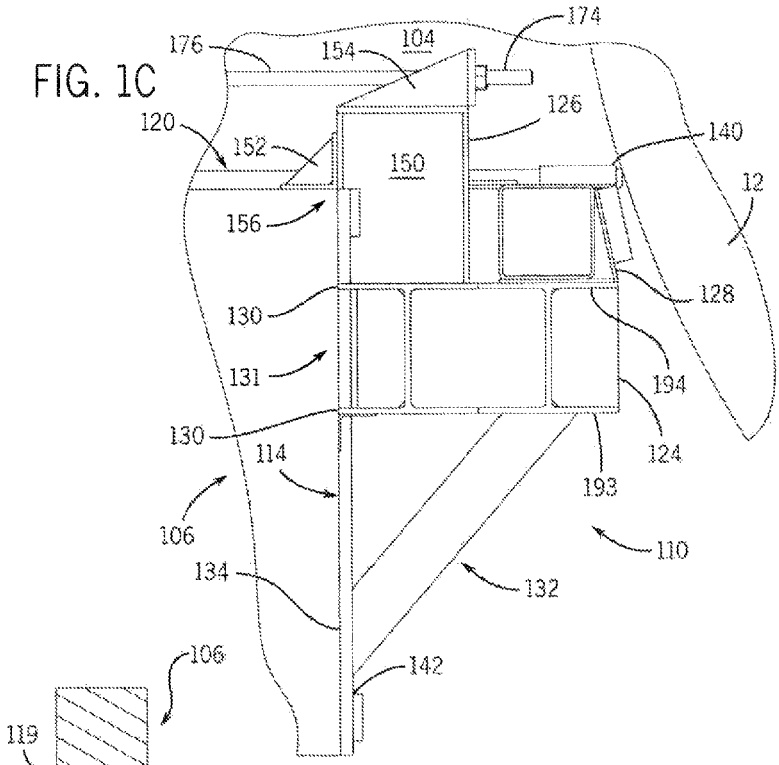
FIG. 1C is a detail cut-away section of the top plan view of FIG. 1 (corresponding generally to region C of FIG. 1), showing certain portions of the submersible bulkhead system in relation to the dam.
Figure 1B:
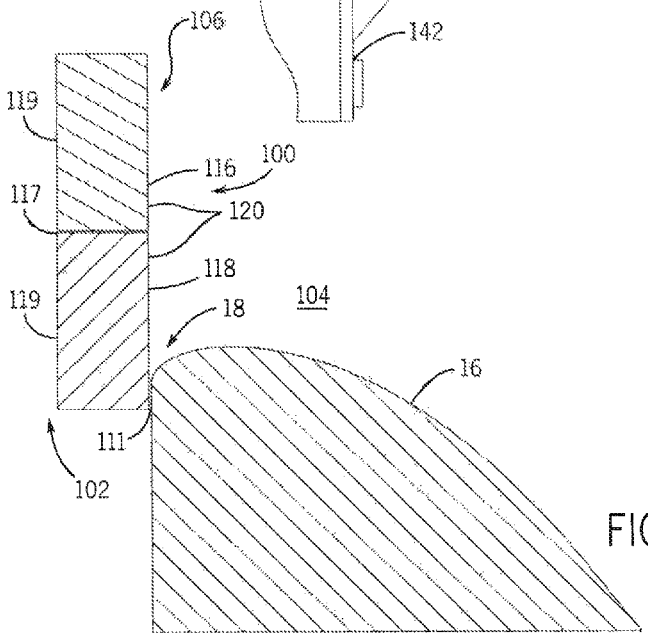

Referring particularly to FIGS. 1A and 1B, these respectively provide cross-sectional views of the bulkhead system 100 taken along lines A-A and B-B of FIG. 1, respectively. FIGS. 1A and 1B omit for clarity any display of the piers such as the pier 10 but do additionally show how the bulkhead system 100 is positioned in relation to the concrete monolith 16, which constitutes (or provides) a spillway crest and extends between the piers 10, 12 beneath the waterline (that is, beneath the normal expected level of the water flowing by the dam 2 when the dam is operational and normal water levels are present).

FIG. 1B particularly shows how in the present exemplary embodiment the bulkhead assembly 106 actually includes first and second (respectively, upper and lower) bulkhead sections 116 and 118, respectively, each of which has (among other things) a respective upstream side surface 119 and a respective downstream side surface 120. Each of the bulkhead sections 116, 118 (each of which can also be referred to as a sectional barge) is an elongated box-shaped structure having dimensions such that, when the bulkhead system 100 is fully implemented in relation to the dam 2, each of the bulkhead sections has a horizontal length (intended to extend most of the distance between the piers of the dam 2) that is greater than either the vertical height or thickness (viewed upstream-to-downstream) of the bulkhead section. When assembled together to form the bulkhead assembly 106, the bulkhead sections 116, 118 particularly are arranged to interface one another along a horizontal (or substantially horizontal) interface surface 117. The bulkhead sections 116, 118 (and any additional bulkhead sections when more than two are utilized) typically are manufactured, designed, and/or selected so that the bulkhead sections have sufficient strength (e.g., in terms of structural section modulus) suitable for the application or environment for which the bulkhead system 100 is being employed. In at least some embodiments, for example, each of the bulkhead sections 116, 118 (and/or any additional bulkhead sections where more than two are utilized) is a respective SERIES-50 QUADRA (or Quadrafloat) sectional barge or other FLEXIFLOAT® steel float or modular barge as manufactured by Robishaw Engineering, Inc. of Houston, Tex.

As also shown, it is the second (lower) bulkhead section 118 of the bulkhead assembly 106 that in the present example is in contact with an upper edge 18 of the monolith 16. More particularly, in this example, a seal component 111 along or proximate to the bottom of the downstream side surface 120 of the second (lower) bulkhead section 118 particularly is in contact with the upper edge 18 of the monolith 16 such that a watertight seal is formed between the monolith and the bulkhead assembly 106. As for FIG. 1A, there it is shown how a portion of the first side assembly 108 also is in contact with the upper edge 18 of the monolith 16, again by way of a seal component 122 positioned along a downstream side surface 123 of that side assembly (particularly a rear edge 182 of one of the steel structural portions thereof as discussed below), such that a watertight seal again is formed in relation to the monolith.

Figure 1E:
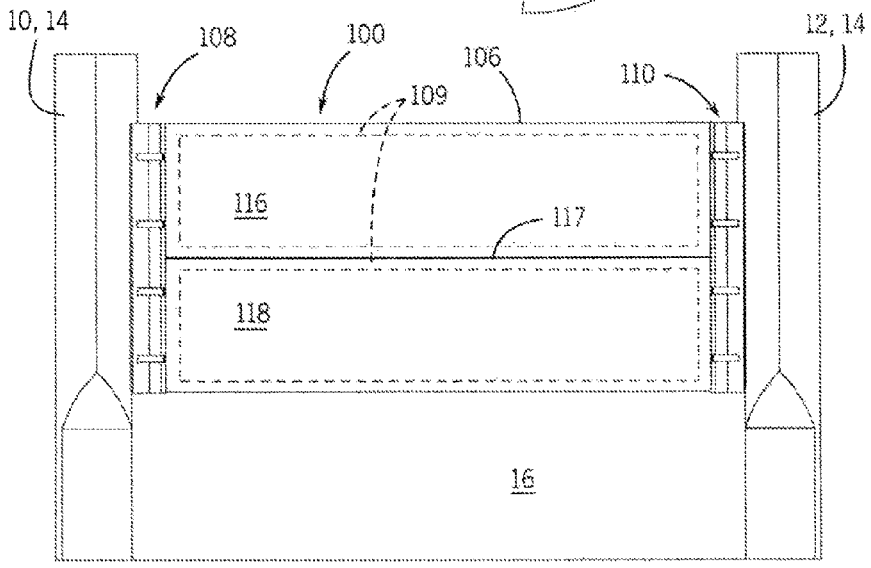
FIG. 1E shows a front view of the submersible bulkhead system and dam of FIG. 1.
Figure 1G:
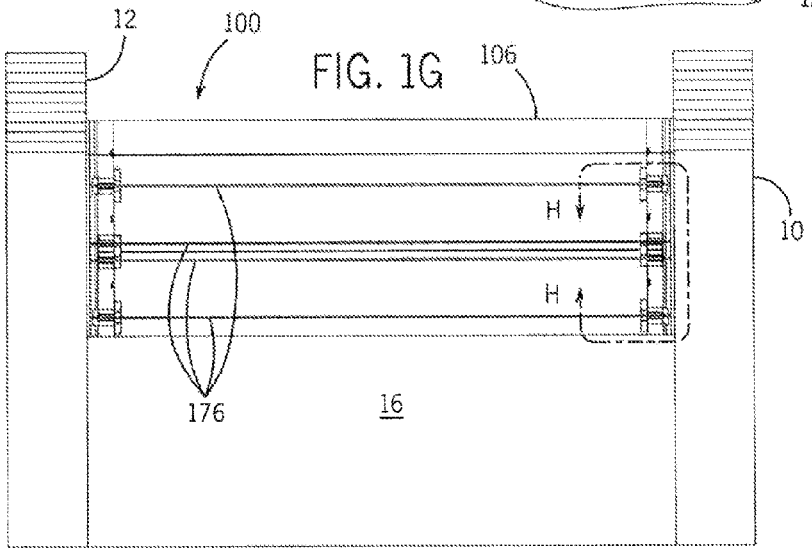
FIG. 1G shows a rear view of the submersible bulkhead system and dam of FIG. 1.
Figure 2:
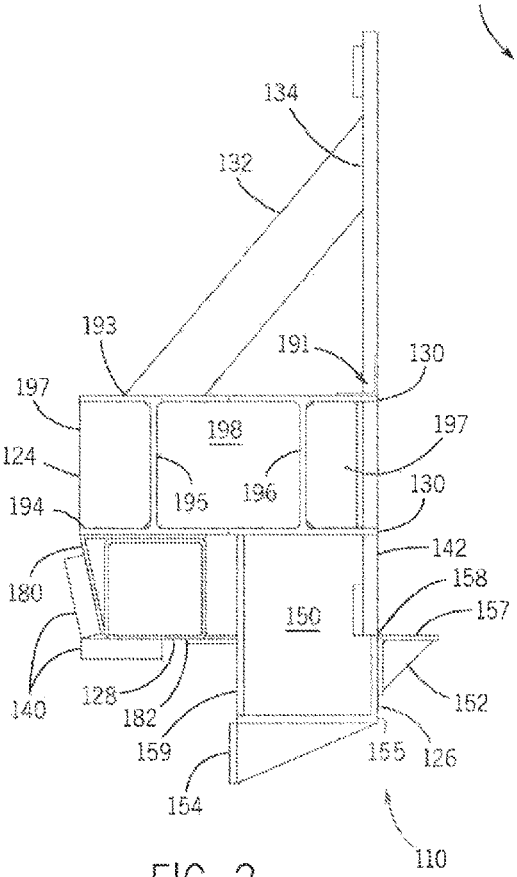
FIG. 2 is a top plan view of one of a pair of side assemblies of the submersible bulkhead system of FIG. 1, corresponding closely to the detail cut-away section of FIG. 1C except insofar as the side assembly is shown independent of other portions of the bulkhead system and independent of the dam.
Figure 2A:
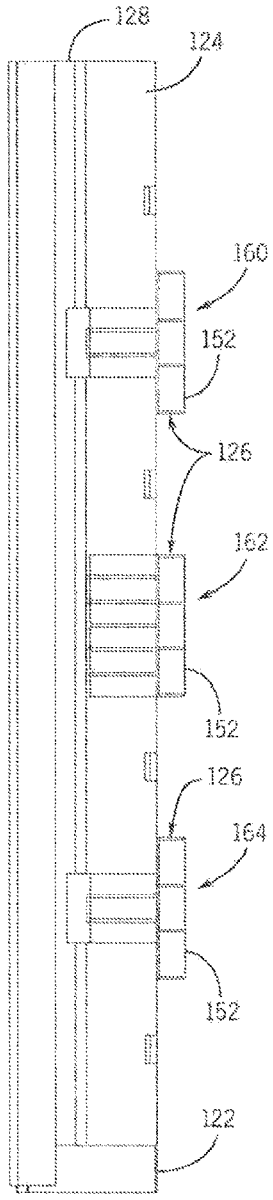
FIGS. 2A, 2B, and 2C respectively are additional rear elevation, side elevation, and front elevation views, respectively, of the side assembly that is the subject of FIG. 2.
Figure 2B:
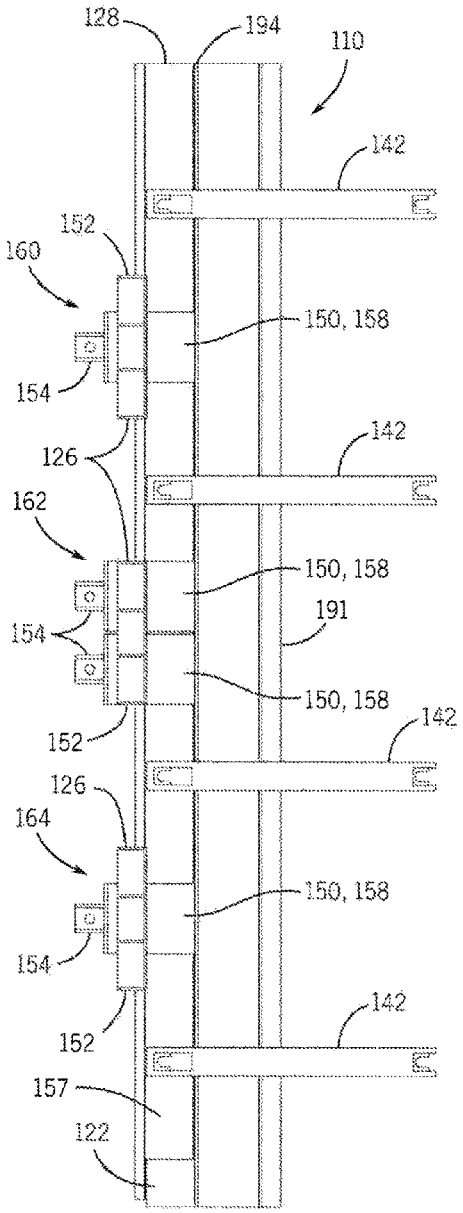
Figure 2C:
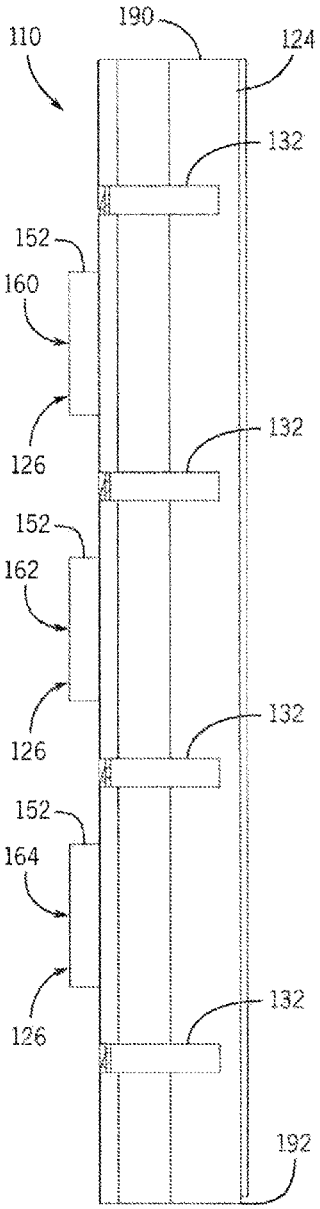
Figures 2D, 2E:
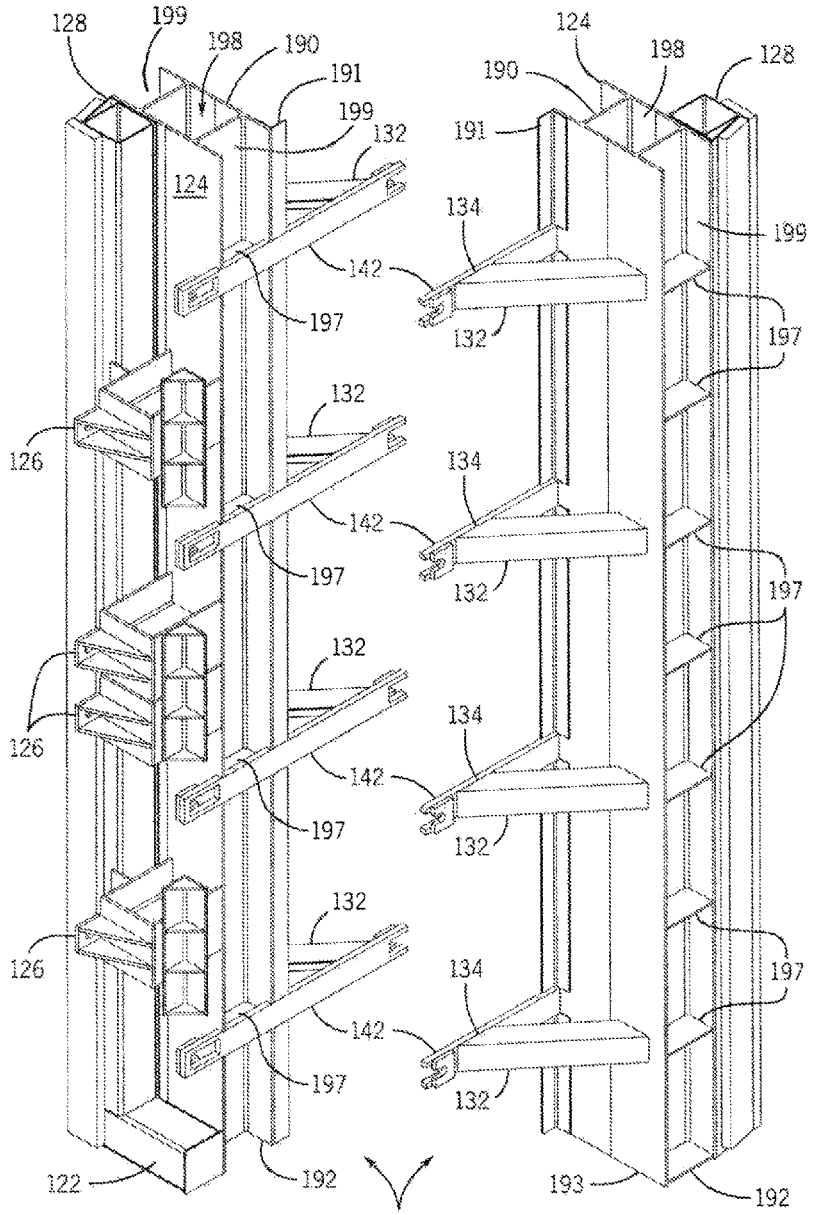
FIGS. 2D and 2E respectively are rear and front perspective views, respectively, of the side assembly that is the subject of FIGS. 2-2C.

Turning to FIG. 1C and further to FIGS. 2-2E, the second side assembly 110 of the bulkhead system 100 is shown in more detail. FIG. 1C particularly is a detail cut-away section (taken in relation to FIG. 1) of the top plan view of the second side assembly 110 in combination with the second end surface 114 of the bulkhead assembly 106 and the second pier 12 (with the second end surface 114 and second pier 12 being shown in cutaway), while FIGS. 2-2E show various views of the second side assembly independent of the pier and bulkhead assembly. More particularly, FIG. 2 is an enlarged (by comparison with FIGS. 2B-2E) top plan view of the second side assembly 110. FIGS. 2C and 2A respectively are front elevation and rear elevation views of the second side assembly 110, respectively (that is, the view looking downstream toward the dam 2 corresponding to the view of FIG. 1E and the view looking upstream toward the dam corresponding to the view of FIG. 1G, respectively), while FIG. 2B is a left side elevation view of the second side assembly 110 (that is, the second side assembly 110 as viewed from the second end surface 114 of the bulkhead assembly 106). FIGS. 2E and 2D respectively provide additional front perspective and rear perspective views of the second side assembly 110.

Figure 1D:
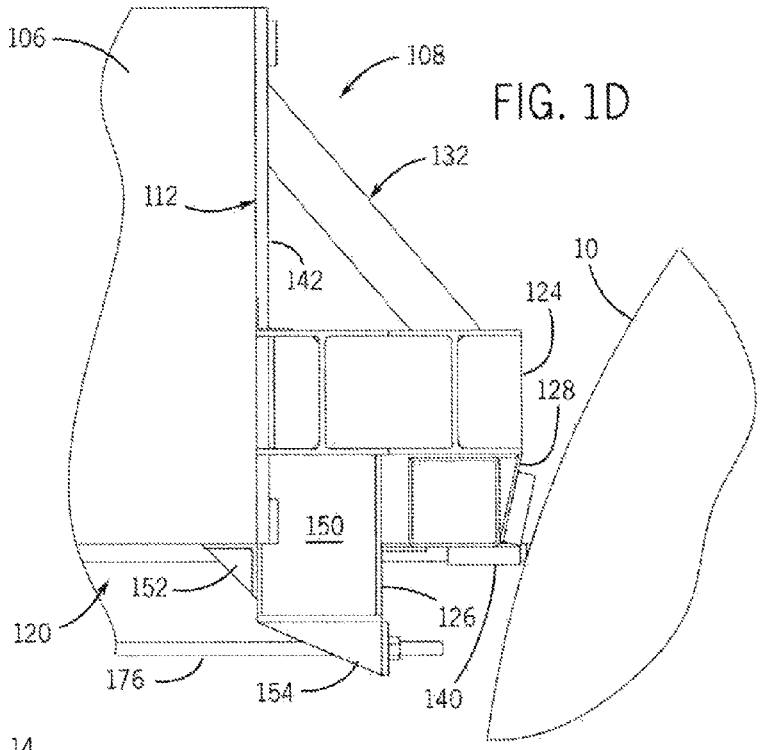
FIG. 1D is an additional detail cut-away section of the top plan view of FIG. 1 (corresponding generally to region D of FIG. 1), showing certain portions of the submersible bulkhead system in relation to the dam.
Figure 1F:
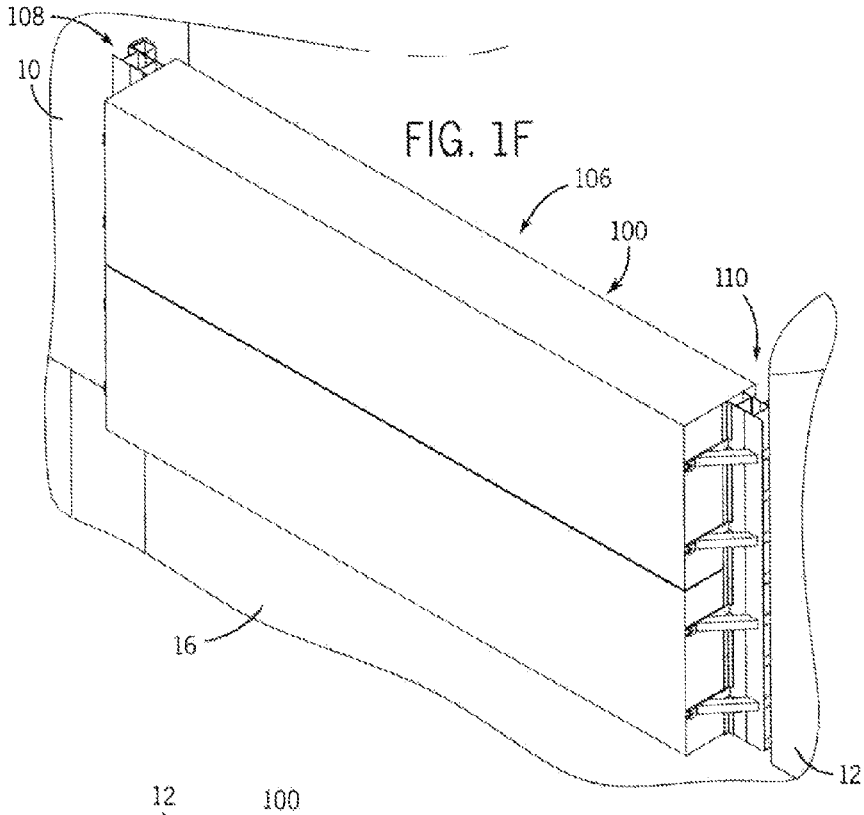
FIG. 1F shows a further perspective view, shown in cutaway, of the submersible bulkhead system and dam of FIG. 1.
Figure 1H:
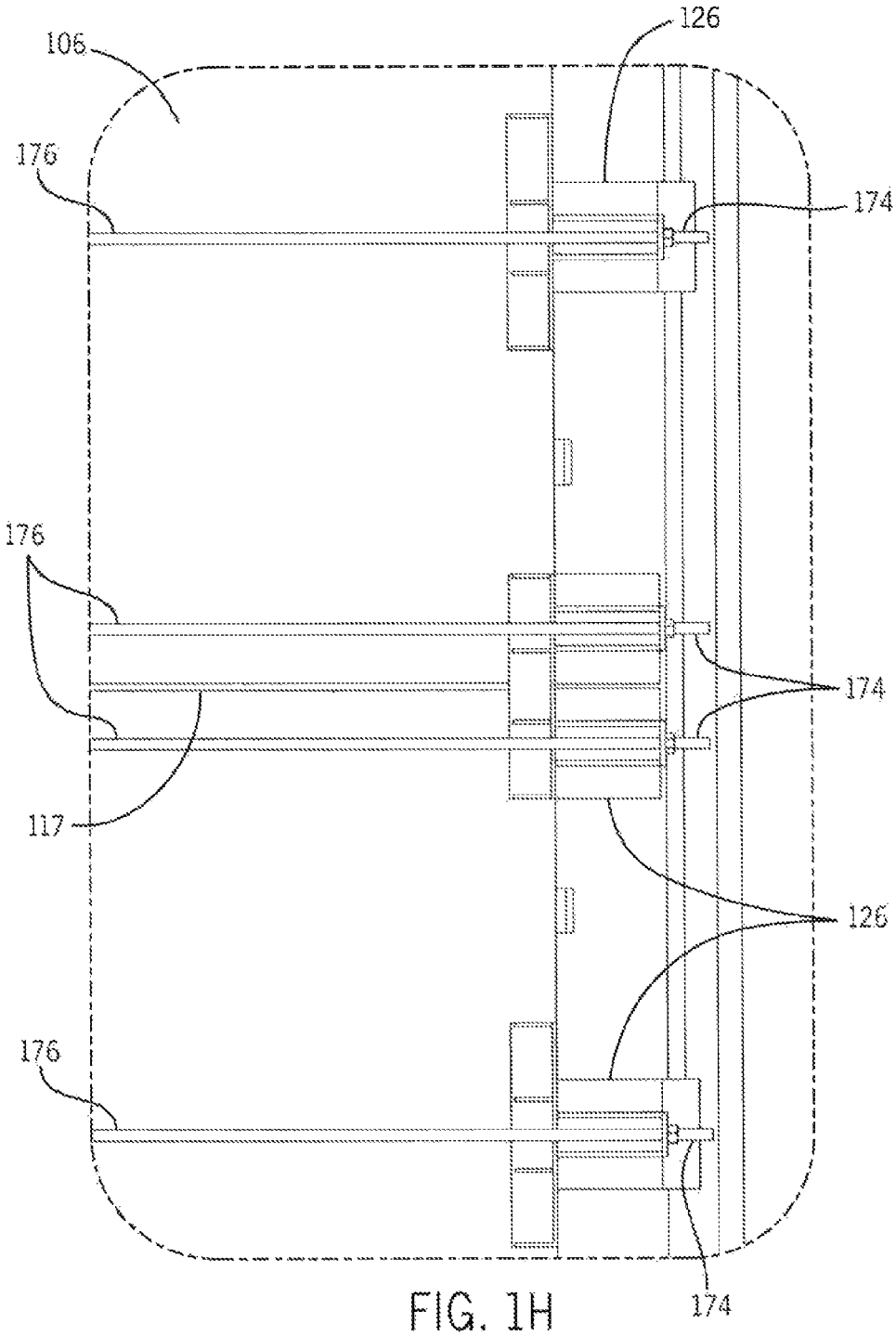
FIG. 1H is a further detail cut-away section of the submersible bulkhead system and dam as shown in FIG. 1G (corresponding generally to region H of FIG. 1G)

By comparison with FIG. 1C, FIG. 1D is a detail cut-away section (taken in relation to FIG. 1) of the top plan view of the first side assembly 108 shown in relation to the first end surface 112 of the bulkhead assembly 106 and the first pier 10 (with the first end surface and first pier being shown in cutaway). Although additional figures corresponding to FIGS. 2-2F are not provided to show additional details of the first side assembly 108, it should be appreciated that the first side assembly is of the same design as the second side assembly 110 in terms of its components and their arrangement and functionality, except insofar as the first side assembly 108 is a mirror image of the second side assembly such that the first side assembly 108 is suitable for being positioned between the first end surface 112 of the bulkhead assembly 106 and the first pier 10. That is, all discussion provided below regarding FIG. 1C and FIGS. 2-2E concerning the second side assembly 110 can be assumed to be equally applicable to the first side assembly 108 except insofar as the component parts and arrangement thereof in the first side assembly is a mirror image of those in the second side assembly, with the mirror image being taken with respect to a reflection plane defined by the axis of flow (upstream to downstream) and a vertical (up to down) axis.

Referring again to FIG. 1C and FIGS. 2-2E, the second side assembly 110 includes several subcomponents, including a first structural steel member 124, a plurality of second structural steel members 126, and a third structural steel member 128. Each of the structural steel members 124, 126, 128 can be or include one or more hollow structural steel tubes or tubular formations and/or can include one or more other steel formations such as elongated steel surfaces and plates. FIG. 1C and FIGS. 2-2E show one embodiment of formations that can be employed in the second side assembly 110 as the structural steel members 124, 126, 128, albeit it should be appreciated that a variety of other arrangements are also possible in alternate embodiments. In some other embodiments, the particular material that is used for any one or more of the structural steel members can range from any of a variety of types of steel (including even possibly stainless steel) to other materials that provide sufficient strength and rigidity (including other metallic materials and/or even other non-metallic materials such as carbon composite materials). The fact that in the present embodiment there are multiple ones (in this example, four) of the second structural steel members 126, located respectively at different vertical levels on the second side assembly 110, is particularly evident from FIG. 2D. However, as discussed further below, the number and configuration of the various structural steel members 124, 126, 128 (or other structural members) can vary from that shown depending upon the embodiment.

With respect to the first structural steel member 124 of the present embodiment in particular, when the second side assembly 110 is implemented in relation to the bulkhead assembly 106 and the dam 2 as shown in FIG. 1C, this steel member is configured to jut out sideways from a first region or location 131 along the second end surface 114 (which is the side edge) of the bulkhead assembly 106. More particularly, vertical side edges 130 of the first structural steel member 124 are in contact with the second end surface 114 at the first location 131, and the first structural steel member juts out sideways away from the first location 131 toward, but stops short of, the second pier 12. Also, as shown in FIGS. 2C-2E, the first structural steel member 124 is an elongated tubular (typically hollow) beam member having a top end 190 and a bottom end 192 that when implemented as part of the bulkhead system 100 in relation to the dam 2 is oriented in a vertical manner such that the bottom end is proximate the concrete monolith 16 of the dam and the top end is above the bottom end.

Further as shown in more detail in FIG. 2, in the present embodiment the first structural steel member 124 includes a front wall 193 and a rear wall 194 that extend the entire vertical length of the first structural steel member, as well as first and second connection walls 195 and 196 that respectively extend and couple the front and rear walls along their entire vertical lengths, plus a plurality of stiffeners 197 positioned at different levels vertically within the structural steel member (the stiffeners 197 being most clearly shown in FIGS. 2D and 2E). In the present embodiment, the first and second connection walls 195, 196 are positioned inwardly of the vertical side edges of the first structural steel member 124, such that those connection walls in combination with the front wall 193 and rear wall 194 define both an internal (central) tubular cavity 198 as well as two side pockets 199 on opposite sides of the internal tubular cavity, where each of the internal tubular cavity and the two side pockets extends the entire vertical length of the first structural steel member. As shown, the stiffeners 197 particularly are positioned at different vertical levels within each of the two side pockets 199 and thus divide each of those side pockets into a respective vertically-arranged series of smaller pockets. Although the stiffeners 197 can all be the same size, this need not be the case in all embodiments and, in the present embodiment as shown in FIG. 2, those of the stiffeners 197 positioned proximate the edges 130 are slightly smaller in extent (and particularly do not extend all of the way from the first connection wall 196 to the edges) than the stiffeners extending from the second connection wall 195.

Although in the present embodiment, the first structural steel member 124 includes the walls 193, 194, 195, 196 defining the single internal tubular cavity and the two side pockets, in other embodiments other types of members can be employed that have different structural features. For example, in another embodiment, there can be present more than two connection walls such that more than one internal tubular cavity is present, and/or depending upon the placement of connection walls one or both of the side pockets can be absent or the side pockets can be different in size relative to one another. Also, although the present embodiment includes the stiffeners 197, in other embodiments such stiffeners need not be present (and also in other embodiments such stiffeners can be spaced differently than as shown).

Further as shown in FIG. 1C (and also in FIGS. 2-2E), the second side assembly 110 additionally includes a plurality of structural gussets 132, a plurality of support struts 142, and one or more (in this case, more than one) additional formations 191. In the present embodiment, there are four of each of the structural gussets 132 and four of the support struts 142 albeit, in other embodiments, other numbers of each of these components can be present in the second side assembly 110 (as well as in the first side assembly 108). As shown, the respective support struts 142 are respectively positioned at different respective vertical levels alongside the vertical side edges 130 of the front wall 193 and rear wall 194 of the first structural steel member 124 and extend both forward (that is, in a direction that is upstream away from the dam 2 when the bulkhead system 100 is implemented in relation to the dam) and rearward (that is, in a direction that is downstream) from those vertical side edges. It should be appreciated from FIG. 21) that the stiffeners 197 in the side pocket 199 adjacent the support struts 142 are positioned at the same vertical levels as those support struts. Also, when the second side assembly 110 is assembled in relation to the bulkhead assembly 106 as shown in FIG. 1C, the support struts 142 due to their forward extending portions also extend alongside the second end surface 114 of the bulkhead assembly 106.

The respective structural gussets 132 are also respectively positioned at different respective vertical levels along the first structural steel member 124 that coincide with the respective vertical levels at which are positioned the respective support struts 142. As shown, the respective structural gussets 132 are respectively coupled to the respective support struts 142 and extend diagonally outward away from the respective support struts 142 (that is, in a direction away from the bulkhead assembly 106 when the second side assembly 110 is assembled thereto), from respective locations 134 that are along a common vertical axis, so as to be ultimately connected with the front wall 193 of the first structural steel member 124. Thus, when the second side assembly 110 is assembled in relation to the bulkhead assembly 106, the support struts 142 are between that bulkhead assembly and respective ones of the structural gussets 132, as well as between that bulkhead assembly and the first structural steel member 124 (albeit depending upon the embodiment the vertical side edges 130 or portions thereof can also be in direct contact with the bulkhead assembly 106). Further, when the bulkhead system 100 is implemented in relation to the dam 2, the structural gussets 132 extend outward diagonally away from the bulkhead assembly 106 toward the second pier 12, generally in a downstream direction.

As for the additional formations 191, as shown in FIGS. 2, 2B, 2D, and 2E, these formations form a flange (or multiple flange portions) that is positioned along the front wall 193 of the first structural steel member 124 at the vertical side edge 130 thereof. In the present embodiment, each of the additional formations has a cross-section (as viewed from the top as shown in FIG. 2) that is L-shaped, with one leg of the L running outward along the front wall 193 from the vertical side edge 130 and the other leg of the L running forward parallel to the support struts 142. The additional formations 191 can be welded to the first structural steel member 124 and even be considered part of the first structural steel member. Although in some embodiments the additional formations can be a single formation that extends continuously vertically the entire length of the first structural steel member 124, in other embodiments including the present embodiment the additional formations 191 are multiple formations that each respectively extend only a portion of the vertical length of the first structural steel member 124 (e.g., multiple formations that collectively extend the length of the first structural steel member but are interrupted by the support struts 142).

Still referring to FIGS. 1C and 2-2E, the second structural steel members 126 of the second side assembly 110 are positioned along the rear wall 194 of the first structural steel member 124. More particularly as shown, in the present embodiment, the second structural steel members 126 particularly include an upper member 160, a middle member 162, and a lower member 164 that are respectively positioned at upper, middle, and lower locations respectively alongside the rear wall 194 (see particularly FIGS. 2A-2C). As in the present embodiment there are four of the support struts 142 spaced at different vertical locations along the first structural steel member 124, in the present embodiment the upper member 160 is positioned in between the two uppermost ones of the support struts 142, the lower member 164 is positioned in between the two lowermost ones of the support struts 142, and the middle member 162 is positioned in between the two uppermost and two lowermost ones of the support struts 142. In other embodiments, the numbers and relative positioning of each of the support struts 142, the structural gussets 132, and the second structural steel members 126 can vary from that shown. For example, in another embodiment, the second side assembly 110 can include only three of the support struts, three of the structural gussets, and only the upper and lower members of the second structural steel members.

In the present embodiment, each of the second structural steel members 126 includes a respective primary rectangular portion 150, a respective angular buttress portion 152 and a respective further angular portion 154. As is evident from FIG. 1C, the primary rectangular portion 150 and the angular buttress portion 152 of each of the second structural steel members 126 are configured to conform to a complementary rear (downstream) corner 156 of the bulkhead assembly 106. More particularly, a respective inner side edge 158 (see particularly FIGS. 2 and 2B) of each of the primary rectangular portions 150 is aligned with the vertical side edges (or inner vertical edges) 130 of the rear and front walls 194 and 193 of the first structural steel member 124, such that the inner side edge 158 of each of those rectangular portions will generally be in contact with the second end surface 114 of the bulkhead assembly 106 when the second side assembly 110 is assembled in relation thereto. Thus, the inner side edges 158 of the rectangular portions 150 serve to support the bulkhead assembly 106 and particularly serve to prevent or counteract side-to-side shifting movement of the bulkhead assembly (e.g., movement toward or away from the pier 12 when the bulkhead system 100 is implemented in relation to the dam 2).

Additionally, the respective angular buttress portions 152 are right triangular formations that are formed integrally with respect to (or mounted on) the respective inner side edges 158 of the respective primary rectangular portions 150 and jut inwardly relative to the inner side edges (that is, toward the center of the bulkhead assembly 106 when the second side assembly 110 is assembled thereto). Each of the respective angular buttress portions 152 is particularly configured so that a respective front edge 157 of each of the buttress portions extends perpendicularly relative to the inner side edge 158 of the corresponding rectangular portion 150, and is configured to contact one of the downstream side surfaces 120 of the bulkhead assembly 106 (see FIG. 1C) when the second side assembly 110 is assembled to the bulkhead assembly 106 (the respective edge constituting the hypotenuse of each respective angular buttress portion 152 extends from the tip of the respective angular buttress portion, located inward relative to the inner side edge 158, outward and rearward toward the inner side edge). By virtue of this arrangement the angular buttress portions 152 are particularly capable of supporting the bulkhead assembly 106 so as to counteract downstream pressure applied to the bulkhead assembly 106 when the bulkhead system 100 is implemented in relation to the dam 2 and water pressure is borne by the bulkhead assembly 106. That is, the angular buttress portions 152 provide shear connections to the bulkhead assembly 106 (barges) when the bulkhead assembly is in place.

Further as shown, each of the second structural steel members 126 additionally includes one or more of the further angular portions 154. FIG. 2 particularly shows that in the present embodiment, each of the further angular portions 154 of each respective second structural steel member 126 is a right triangular formation that has the same rotational orientation as the respective angular buttress portions 152 of the respective second structural steel member. However, each of the further angular portions 154 is integrally formed on (or welded to or otherwise mounted to) the respective primary rectangular portion 150 of the respective second structural steel member along a rear edge 155 of the respective primary rectangular portion, and juts out rearward of the respective primary rectangular portion (that is, extends outward in a direction that is downstream when the bulkhead system 100 is implemented in relation to the dam 2).

In contrast to the angular buttress portions 152, which include the front edges 157 intended to interface to the bulkhead assembly 106, the further angular portions 154 are not intended to contact or directly support the bulkhead assembly 106. Rather, each of the further angular portions 154 is configured to support a respective first end 174 of a respective threaded rod 176 that extends between that further angular portion of the second structural steel member 126 of the second side assembly 110 and a complementary (mirror image) further angular portion of a complementary (mirror image) second structural steel member of the first side assembly 108, which supports a respective second end 178 (visible in FIG. 1) of that threaded rod. That is, as shown in FIG. 1, each such threaded rod 176 extends in a direction generally parallel to the downstream side surfaces 120 of the bulkhead assembly 106, with a space existing between the threaded rod and the downstream side surfaces.

It should be further appreciated from close inspection of FIG. 2A that the middle member 162 of the second structural steel members 126 is slightly different from the upper member 160 and lower member 164 of the second structural steel members in two respects. First, the primary rectangular portion 150 of the middle member 162 is double the length of the primary rectangular portion found in each of the upper and lower members 160, 164. Second, in contrast to the upper and lower members, the middle member 162 includes two of the further angular portions 154 rather than merely one (as present in each of the upper and lower members). Thus, the middle member 162 connects to and supports two of the threaded rods 176 and not merely a single one of the threaded rods, and so in the present embodiment the bulkhead system 100 when fully assembled includes four (rather than merely three) of the threaded rods 176 extending between the first and second side assemblies 108, 110 (only one of those threaded rods is visible in FIG. 1 since all of the threaded rods are vertically aligned with one another). Notwithstanding the aforementioned distinctive features of the second structural steel members 126, one or more of these features can vary depending upon the embodiment. For example, in one alternate embodiment, the middle member 162 need only have a single one of the further angular portions 154 and support only one of the threaded rods 176.

As for the third structural steel member 128, this member is located adjacent to the first structural steel member 124, along the rear wall 194 thereof (and thus downstream of the first structural steel member), and also is located adjacent to the second structural steel members 126, on outer side edges 159 of the primary rectangular portions 150 thereof opposite the inner side edges 158 thereof (which as noted above are configured to contact the second end surface 114 of the bulkhead assembly 106). The third structural steel member 128, in contrast to the second structural steel members 126, is a member that extends the same vertical length as the first structural steel member 124, and the third structural steel member 128 is mounted to (or otherwise coupled to or in contact with) the first structural steel member 124 in such a manner that the junction therebetween is sealed in a watertight manner. The third structural steel member 128 in the present embodiment includes a rectangular tubular member 127 with an internal vertically-extending cavity, albeit in other embodiments the third structural steel member can instead include another vertically-extending structure such as a structure having a C-shaped cross-section, where one edge of the C is mounted to the first structural steel member 124 and the other end of the C is in contact with the second structural steel members 126.

The third structural steel member 128 is the particular portion of the second side assembly 110 that allows for sealing of that side assembly to the second pier 12 and concrete monolith 16 of the dam 2. In particular, the third structural steel member 128 in addition to the vertically-extending rectangular tubular member 127 also includes the seal component 122 already mentioned above (see FIGS. 2A, 2B, and 2D in particular) so as to allow for sealing of the third structural steel member to the concrete monolith 16 of the dam 2 when the bulkhead system 100 is implemented in relation to the dam. The seal component 122 can be, for example, an additional horizontally-extending tubular member.

Further as shown in FIGS. 1C and 2, an additional seal component 140 is formed along an outer side edge 180 and a rear edge 182 of the third structural steel member 128. In the present embodiment, the additional seal component 140 can include a two inch by eight inch (2"×8") cofferdam seal alone or in combination with an additional side plate (where the cofferdam seal is along the outer side edge 180 of the third structural steel member and the additional side plate is along the rear edge 182 and extends outward to and slightly past the outer side edge). Depending the upon the embodiment, the additional seal component 140 can also be formed from multiple seal portions that are positioned adjacent to one another (each seal or seal portion will typically extend continuously along the entire vertical length of the third structural steel member 128). As can be seen from FIG. 1, it is the additional seal component 140 that is in contact with the pier 12 so as to form a watertight seal in relation thereto when the bulkhead system 100 is fully implemented in relation to the piers 10, 12 and the concrete monolith 16 so as to serve its dewatering function. Although not shown, in at least some embodiments a further seal component of similar structure to the additional seal component 140 can also be provided as part of or in addition to the seal component 122 mentioned above for further assisting in the sealing of the base of the second side assembly 110 to the concrete monolith 16. The additional seal component 140 (cofferdam seal) and/or other seal components such as the aforementioned further seal component (for further assisting in the sealing of the base to the concrete monolith) can be made of a variety of different materials depending upon the embodiment including, for example, neoprene rubber designation N-41.

In view of the above, therefore, the bulkhead system 100 when implemented in relation to portions of the dam 2 provides a watertight seal (or, perhaps if imperfectly implemented, a substantially watertight seal) so as to prevent water upstream of the bulkhead system from proceeding into the region downstream of the bulkhead system, due to the watertight seals established between the bulkhead system and the dam. More particularly, the additional seal component 140 of the second side assembly 110 seals that side assembly in relation to the second pier 12, a corresponding (complementary or mirror image) additional seal component of the first side assembly 108 seals that side assembly in relation to the first pier 10, the seal components 122 of the two side assemblies 108, 110 seal the base regions of those side assemblies in relation to the concrete monolith 16, and the seal component 111 seals the bulkhead assembly 106 in relation to the concrete monolith 16.

Additionally it should be noted that, in the present embodiment, the bulkhead system 100 is particularly strengthened/reinforced in several manners so as to resist the forces of water along its upstream side that are unbalanced by similar forces on its downstream side when the bulkhead system is fully implemented in relation to the dam 2. First, the structural gussets 132 serve to strengthen the side assemblies 108, 110 to resist forces/torques experienced by those side assemblies due to their positioning between the bulkhead assembly 106 and the piers 10, 12. Second, tension provided by the threaded rods 176 acting upon both of the side assemblies 108, 110 by way of the second structural steel portions 126 also serves to strengthen the overall bulkhead system 100 and to prevent (or resist) bending/bowing of the center regions of the bulkhead system relative to its sides proximate the piers 10, 12.

As already noted, in the present embodiment, the bulkhead assembly 106 includes two bulkhead sections, namely, the first and second (respectively, upper and lower) bulkhead sections 116 and 118. In view of this, the present embodiment includes not merely one but rather four of the threaded rods 176 located at different vertical levels along the bulkhead assembly 106, with two (the upper two) of the threaded rods being associated with the first bulkhead section 116 and the other (lower) two of the threaded rods being associated with the second bulkhead section 118. Notwithstanding the use of two bulkhead sections and four threaded rods in the present embodiment, in other embodiments there can be more or less than two bulkhead sections and more or less than four threaded rods (and more or less than two threaded rods per bulkhead section).

It is further envisioned that the above-described embodiment of the bulkhead system 100 (as well as a variety of other similar embodiments of bulkhead systems) can be implemented/installed/assembled in relation to the piers 10, 12 and the monolith 16 of the dam 2 in a particular manner. To begin with, it should be understood that each of the bulkhead sections 116, 118 in the present embodiment is a submersible bulkhead (or barge) section having a sealable interior cavity 109 (as shown in phantom in FIG. 1E) that can be filled with ballast (e.g., water) or emptied of ballast (e.g., so that there is air within the interior cavity). In at least some embodiments, such filling and emptying can be achieved by way of two water inlets/outlets associated with each of the bulkhead sections 116, 118 (the inlets/outlets are not shown). Filling or emptying of a respective bulkhead section can be accomplished by way of one or more pumps (also not shown) associated with that bulkhead section, such as an electric water pump (or a gas pump), as well as associated internal/external piping systems, so as to facilitate the submerging and ballasting of the bulkhead sections (barges) by pumping water into/out of the bulkhead sections (barges). In alternate embodiments, filling with water can also or instead be accomplished simply by way of gravity flooding (that is, letting water naturally flow into the water inlet(s) due to gravity).

Figure 3:
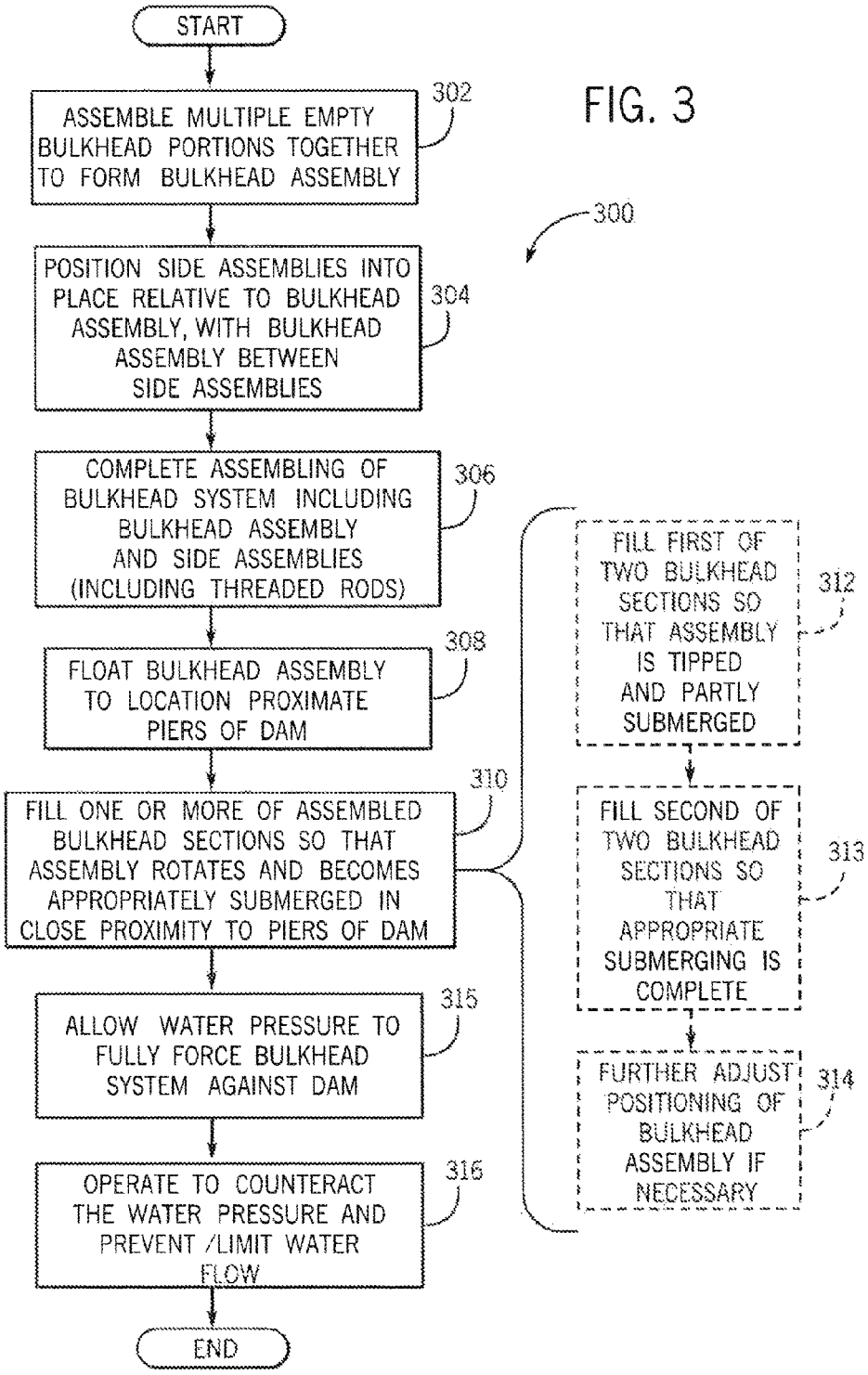
FIG. 3 is a flow chart showing steps of an example process of implementing/installing the bulkhead system of FIGS. 1-2F in relation to a dam such as that of FIGS. 1-1H.

Given such a design of bulkhead sections such as the bulkhead sections 116, 118, the process of implementing the bulkhead system 100 can be performed in a manner as shown by a flow chart 300 in FIG. 3. As shown, upon starting, the process begins at a step 302 at which a desired number of bulkhead sections, for example, the two bulkhead sections 116 and 118, are (after being trucked/delivered to a given site) attached to one another to form a bulkhead assembly, such as the bulkhead assembly 106. This fastening can be accomplished in any of a variety of manners, including for example by way of one or more fasteners of any of a variety of types. Once the bulkhead sections 116, 118 of the bulkhead assembly 106 are assembled, at a step 304 the first and second side assemblies 108 and 110 are then respectively positioned into place relative to the bulkhead assembly 106 (respectively along the first and second end surfaces 112 and 114 of the bulkhead assembly), with the bulkhead assembly between those side assemblies. Then, at a step 306, assembly of the bulkhead system 100 overall is fully completed. More particularly, this final completion of the assembly process at the step 306 can involve a number of substeps including, for example, attaching/coupling of the side assemblies 108, 110 in relation to the bulkhead assembly 106 by way of one or more fasteners, and installation of the threaded rods 176 between the second structural steel members 126 (between the further angular portions 154 thereof).

It should be appreciated that, when emptied or substantially emptied of water, each of the bulkhead sections 116, 118 and thus the bulkhead assembly 106 will float within a waterway. Further, in the present embodiment, the bulkhead assembly 100 comprising those bulkhead sections 116, 118 (and the bulkhead assembly 106) will float within a waterway. Given this to be the case, the bulkhead system 100 (including the bulkhead sections 116, 118/bulkhead assembly 106) can therefore be easily floated toward and moved into location relative to the piers 10, 12. Thus, at a step 308, the bulkhead assembly 106 achieved at the step 302 (and indeed the bulkhead system 100 overall) is floated to a location proximate to the piers 10, 12 (and concrete monolith 16) of the dam 2 with respect to which the bulkhead system 100 is to be installed.

Once the bulkhead system 100 including the bulkhead assembly 106 is in position near the dam 2, then at a step 310 one or more of the bulkhead sections is/are individually filled with ballast (water) as appropriate to submerge the overall bulkhead assembly (and thus the bulkhead system) in the desired manner. This filling process can depend upon a variety of circumstances, the operational conditions, and/or the number of characteristics of bulkhead section(s) that are employed in the bulkhead system 100/bulkhead assembly 106. For example, in the present embodiment involving the two bulkhead sections 116 and 118, the step 310 can involve performing of a first substep 312 at which the second bulkhead section 118 is first filled with water (e.g., water is pumped in) so that the overall bulkhead assembly 106 is tipped and the second bulkhead section particularly becomes submerged. Then once the second (lower) bulkhead section 118 is fully ballasted, a second substep 313 is performed at which the first bulkhead section 116 is also filled with water (with the pumping being switched) as appropriate and partly submerged to a desired level (with a portion of the bulkhead assembly 106 remaining above the water line). The substeps 312 and 313 are shown with dashed lines to indicate that this manner of performing the step 310 is optional and that the step 310 can be performed in a variety of other manners as well (for example, in another scenario, the first bulkhead section 116 need not be filled at all with ballast).

Among other things, submerging of the bulkhead assembly 106 involves positioning the bulkhead assembly so that it is positioned so that the downstream side surface 120 of the second bulkhead section 118 (or the seal component 111 associated therewith) is in contact with the concrete monolith 16 and so the bulkhead assembly 106/bulkhead system 100 is positioned so as to be centered between (or more-or-less centered between) the piers 10, 12 of the dam 2. Submerging can in some cases already render the bulkhead assembly 106/bulkhead system 100 fixed in relation to the dam 2 (or the monolith 16 thereof, or in relation to a riverbed or other fixture), albeit this need not be always the case. As represented by a further substep 314, in at least some circumstances the performing of the substep 313 does not result in the bulkhead assembly 106/bulkhead system 100 being fixed in place but rather, at the substep 314, further adjustment of the positioning of the bulkhead assembly can still occur after the submerging. Such further adjustment is possible, in at least some cases, because the bulkhead assembly 106/bulkhead system 100 is still floating even after being filled with ballast and therefore can still be floated further into the proper position. That is, once the bulkhead assembly 106/bulkhead system 100 is correctly ballasted, and floated above the dam 2 (tainter gate), the entire assembly is carefully aligned and pulled into place.

Once the step 310 has been fully performed, then the process of installation/implantation of the bulkhead system 100 is nearly complete. Since the bulkhead system 100 is properly positioned, the water downstream of the bulkhead system 100 drains away (e.g., the water between the bulkhead and the tainter gate is lowered) and the force of the water along the upstream surface of the bulkhead system provides forces that drive the bulkhead system 100 against the dam 2, compress the seals therebetween, and hold the bulkhead system in place, as represented by the step 315, at which the process is completed. The bulkhead system 100 at this time can be considered to be attached/coupled to the dam 2 albeit the attachment/coupling is merely due to the forcing of the bulkhead system 100 against the dam.

Once this has occurred, as represented by the step 316, the bulkhead system 100 then is fully operational so as to block or limit the flow of water past the bulkhead system, with such blocking/limiting operation including operation to counteract the force of the water pressure bearing on the bulkhead system 100. It should further be appreciated that the counteracting operation particularly includes operation of bracing mechanisms provided in the bulkhead system, including for example both the structural gussets 132 and the angular buttress portions 152. Even though FIG. 3 shows the step 316 as being followed by the end of the process, it should be appreciated that the process of the flow chart 300 can be supplemented (followed) with other process steps. For example, the flow chart 300 can supplemented with additional process steps concerning disassembly of the bulkhead system 100, which in some embodiments can simply involve the undoing of the steps of installation/implementation shown in FIG. 3.

Notwithstanding the ordering of the steps of the flow chart 300 discussed above, in alternate embodiments other processes with other and/or additional steps and/or other orderings of steps can be utilized to implement the bulkhead system 100 or other embodiments of bulkhead systems encompassed herein in relation to a structure such as the dam 2. For example, although in the embodiment of FIG. 3 the side assemblies 108, 110 are fully attached to the bulkhead assembly 106 (or bulkhead sections thereof) prior to that assembly (or sections thereof) being floated toward the dam 2 and prior to the bulkhead assembly being submerged, in alternate embodiments one or both of the side assemblies 108, 110 can be attached to the bulkhead assembly 106 after the bulkhead assembly has been positioned in and is already floating in a waterway, or even possibly after the bulkhead assembly 106 has not only been floated into a position proximate the dam but also been submerged or partly submerged.

Also, in some alternate embodiments, the side assemblies 108, 110 are not only attached/coupled to the bulkhead assembly 106 by way of fasteners (and to one another by way of the threaded rods 176) but also are attached/coupled to the piers 10, 12 by way of additional fasteners. Further, although not done in the present embodiment, it is possible for the assembling of the bulkhead sections (e.g., the assembling of the bulkhead sections 116, 118 in accordance with the step 302) to be deferred until such time as those bulkhead sections are floated proximate to the dam 2. Also, in the event that the bulkhead system only includes a single bulkhead (e.g., only one of the bulkhead sections 116 or 118), the step 302 involving assembly of multiple bulkhead sections can be dispensed with altogether.

As mentioned, attachment of the bulkhead sections 116, 118 to one another can be accomplished by way of any of a variety of types of fasteners. In some cases, the attachment of the bulkhead sections 116, 118 is achieved indirectly by virtue of attachment of the side assemblies to each of the bulkhead sections (that is, the side assemblies hold the bulkhead sections together). Additionally, attachment of the side assemblies 108, 110 to the bulkhead assembly 106 (with the bulkhead sections 116, 118) also can be accomplished by way of any of a variety of types of fasteners. In at least some embodiments, where FLEXIFLOAT® steel floats or modular (sectional) barges (e.g., the SERIES-50 QUADRA sectional barges mentioned above) are employed as the bulkhead sections 116, 118, the bulkhead sections are attached to one another and to the side assemblies 108, 110 by way of FLEXIFLOAT connectors that are also available from Robishaw Engineering, Inc. (mentioned above), where the FLEXIFLOAT connectors are or include complementary male and female connector elements that are formed on the interfacing surfaces of the different sections/assemblies. The support struts 142 in particular can be, in at least some embodiments, such FLEXIFLOAT connectors that serve to connect the side assemblies 108, 110 to the bulkhead sections 116, 118 of the bulkhead assembly 106 (other FLEXIFLOAT connectors used to connect the bulkhead sections to one another are not shown in the figures, but nevertheless can be understood to be present and integrated with those bulkhead sections as well). Additionally, although in some embodiments the bulkhead system 100 is attached to the dam 2 (or to the piers 10, 12 thereof) by way of fastening mechanisms, in other embodiments (including the present embodiment) the bulkhead system 100 is held in position relative to the piers 10, 12 and the monolith 16 of the dam simply due to the force of the water applied to the bulkhead system 100 tending to push that system downstream, in combination with the wedging of the bulkhead system in between the piers 10, 12 (as shown, each of the piers tends to have a concave shape such that downstream movement of the bulkhead system 100 tends to further lock the bulkhead system in between those piers as a result).

It should be appreciated that the present disclosure envisions and encompasses numerous embodiments having a variety of dimensions, features, and characteristics, and the sizes and configurations of the components employed in any given implementation will typically be suited to fit the dimensions and characteristics of the dam. In one embodiment corresponding to the bulkhead system 100 described above with respect to FIGS. 1-3, the bulkhead system is adequate to suit a dam having tainter gates that approximately 44 feet wide and retain about 17½ feet of water (above the sill) at normal pool. Although the bulkhead system 100 can employ a variety of different types of bulkhead sections, in one embodiment, the bulkhead system employs (e.g., as the bulkhead sections 116, 118) two SERIES-50 (or S-50) QUADRA FLEXIFLOAT® modular barges, each of which is 40' long, 10' wide and 5' deep. The bulkhead sections (barges) 116, 118 are connected, using the FLEXIFLOAT connections, to form a 20'×40' sectional barge, which constitutes the bulkhead assembly 100. The bulkhead sections (barges) 116, 118 can be filled or emptied of ballast (e.g., water) as described above. Since the opening at the dam (proximate the tainter gate) is 44 feet wide, the side assemblies 108, 110 are employed to serve as extensions along each end of the bulkhead sections (barges) 116, 118 forming the bulkhead assembly 100.

In this example embodiment, the side assemblies (extensions) 108, 110 also connect to the bulkhead sections (barges) 116, 118 using the FLEXIFLOAT connections, which also reinforces the internal connection of the two bulkhead sections (barges) along the 40' length at which those two bulkhead sections are connected to one another. Also in this embodiment, the first structural steel member 124 of each of the side assemblies (extensions) 108, 110 is formed by two 20-foot long HP 14×89 beams that are welded together to provide an approximately 28-inch wide. The stiffeners 197 discussed above are provided at the outer flanges and inner flanges of the welded beams that are positioned near the pier and near the support struts 142. Further in this embodiment, the rectangular tubular member 127 of the third structural steel member 128 of each of the side assemblies 108, 110 is formed by a 20-foot long 10×10 HSS steel tube, which is attached to the downstream side of the first structural steel member 124 (the welded beams). The additional seal component 140 can include a side plate plus, as mentioned above, the 2 inch by 8 inch cofferdam seal, both of which are attached to this steel tube so as to match the contour of the tainter gate pier. Also, a shorter piece of the 10×10" HSS tubing can be welded to the bottom of each of the side assemblies 108, 110 to constitute the seal component 122 that provides a seal against the bottom sill (concrete monolith 16) of the gate/pier.

In addition, seal material constituting the further seal component discussed above (not shown in the figures) is attached to the side plates and sill connections (e.g., to the seal components 122) to further provide a seal of the side assemblies 108, 110 in relation to the sill (the concrete monolith 16) when installed. This seal material/further seal component can have various dimensions depending upon the embodiment including, for example, 2" in thickness (or some other thickness) by 6" in length, or other dimensions as dictated by the surface profile of the concrete to which it is to seal against (in general, when the surface of the concrete that the cofferdam is sealing against has a rougher surface, then a thicker seal material is needed to conform to the rougher surface profile and vice-versa). A channel with seal material in one embodiment can be pulled up against the bottom of the bulkhead assembly 106 with threaded rod to seal the interior joint between the bulkhead sections (barges) 116, 118 of the bulkhead assembly 106. Seal material can also be placed along the top side of the barge (that is, along the side of the barge that is at the top when the barge is floating), at the portion of barge that will rest against the sill when the barge (bulkhead assembly 106) is submerged.

As mentioned above, the support struts 142 extending from the first structural steel members 124 of the side assemblies 108, 110 can be FLEXIFLOAT connectors. Further, the structural gussets 132 in the present embodiment serving as braces can be 36.5" (in length)×6"×6" HSS tubes that extend from the lower (forward or upstream) part of the support struts 142 up to the outer one of the two HP beams that form the first structural steel member 124 (that is, up to the portion of the front wall or forward surface 193 formed by that one of the HP beams that is closer to the pier when the bulkhead system is implemented), centered on the web. The additional formations 191 running along the first structural steel member 124 can be 4×4×¼" angle section(s). In the embodiment where there are multiple such additional formations 191 that extend along the first structural steel member 124 with the support struts 142 therebetween, the additional formations 191 between the support struts 142 can be 54 inches in vertical length, while the additional formation above the uppermost one of the support struts can be 26.5 inches long and additional formation below the lowermost one of the support struts can be 27.5 inches long.

Further, with respect to the second structural steel members 126, in the present embodiment the primary rectangular portions 150 of these four members (which form a secondary connection system) are formed by four short pieces of the HP 14×89 beams, which are welded vertically to the HP beams that form the first structural steel member 124 at the rear wall (surface) 194 thereof (and particularly to the inner one of the two HP beams that form that first structural steel member). Further, the angular buttress portions 152 in the present embodiment are 6×6×½" (or alternatively ¾") angle plates welded to the inner side edges 158 of the primary rectangular portions 150 formed by the aforementioned beams (that is, the edges along the bulkhead sections/barges). In the present embodiment, each of the angle buttress portions 152 of the four second structural steel member 126 on each of the side assemblies 108, 110 also have 4½ inch gusset stiffeners at each of the four locations. Additionally, in the present embodiment the further angular portions 154 similarly can be formed by ½"-thick (or alternatively ¾"-thick) angle plates that are welded to the primary rectangular portions 150, and each of the threaded rods connecting the further angular portions on the two side assemblies 108, 110 can be a 1⅜" diameter tie rod (150 kilopound per square inch or ksi) such as a DYWIDAG tie rod made from THREADBAR® structural steel as available from DYWIDAG-Systems International (or DSI) GmbH of Aschheim, Germany, also having a place of business at Bolingbrook, Ill.

As noted above, in at least some embodiments a piping system can be installed in the bulkhead sections (barges) that allows the second (lower) bulkhead section 118 to be filled with water, thus causing the bulkhead assembly 106 list to one side with all of the weight supported by the first (upper) bulkhead section 116 and creating a floating upright bulkhead assembly. The first (upper) bulkhead section 116 can also be ballasted with water to adjust the height of the bulkhead assembly 106 in the water. The barge/bulkhead assembly 106 in at least some cases is partially submerged and adjusted for depth to match the gate/sill elevations and then floated into place. Additionally, in one example embodiment where a piping system is used, the piping system includes a water pipe and vent pipe on each end of each of the bulkhead sections (barge) 116, 118, and all of the piping is 3 inch black steel schedule 40 piping. The water inlet/outlet couplings and vent pipe couplings are welded flush to the tops of the bulkhead sections 116, 118 to allow the bulkhead sections to be used in other applications with the installation of a plug. The water couplers also have stand pipes that are installed near the lower edges (when submerged) of the bulkhead sections (barges) 116, 118 at a depth near the bottoms of the bulkhead sections or assembly to aid in removal of the water during demobilization. The vent pipe couplers are installed near the upper edge of the bulkhead sections (barges) 116, 118. The piping also is completely removable for trucking purposes and is secured to the deck of the bulkhead sections/assembly by the couplers and standard pipe clamps that are welded to the deck. The upper ends of the water pipes are equipped with valves and quick connects for the water pumps. All of the pipes are equipped with valves to seal the entire system if needed.

Additionally notwithstanding the above discussion, numerous other embodiments are possible and intended to be encompassed herein as well. For example, depending upon the embodiment, any of various numbers and configurations of sectional barges and end appendages or extensions can be utilized. The particular numbers and/or configurations of such structures can be varied to address different dam pier geometries (in many cases without actually providing precise design information concerning those particular configurations). Although the bulkhead system configuration shown in FIGS. 1-1H and 2-2E is one example of a sound engineering solution for example pier separation and hydraulic head pressures that can be encountered, the modular, systemic approach exemplified by this embodiment can also be modified in many manners. Among other things, variations of this bulkhead system design can be applied to lower hydraulic head applications, and in some such embodiments only one bulkhead section can be employed rather than two or more bulkhead sections (e.g., only one of the bulkhead sections 116, 118, or a single bulkhead section having other configurations, can be employed). It should further be appreciated that the section modulus and section-to-section connection strength properties limit the support/hydraulic head combination that can be adequately addressed in this manner. That said, in some additional alternate embodiments, three bulkhead sections can be used where an appropriate pier separation reduction is encountered. Additionally, side assemblies/end extensions can be eliminated in particular embodiments or replaced by smaller modular structures which would be mounted inboard of the section ends to suite the unique pier contour encountered.

Thus, in view of the above discussion, it should be recognized that the present disclosure is intended to encompass numerous embodiments of bulkhead systems having one, two, three, or even more bulkhead sections as well as embodiments of bulkhead systems employing any of a variety different types of side/end assemblies or structures (including embodiments where no such side assemblies are utilized), and that such various embodiments can be implemented in a variety of circumstances and depending upon a variety of factors including, for example, the unique dam geometry in each situation that is encountered or endemic to a given region/situation. The present disclosure particularly is intended to encompass, among other things, bulkhead systems that are one or both of modular in nature, insofar as any of a variety of modular components can be assembled to form the system (e.g., one or more bulkhead sections as well as one or more side/end assemblies), as well as submersible (or partly submersible) insofar as one or more of the bulkhead sections or other system components can be filled with ballast causing those sections or other system components to become submerged.

It is specifically intended that the present invention not be limited to the embodiments and illustrations contained herein, but include modified forms of those embodiments including portions of the embodiments and combinations of elements of different embodiments as come within the scope of the following claims.

The invention claimed is:

1. A bulkhead system for preventing or limiting water flow, the bulkhead system comprising:

a bulkhead assembly having a first end and a second end, the bulkhead assembly including first and second bulkhead sections that each extend between the first and second ends, that are positioned adjacent to one another along a horizontal or substantially horizontal interface surface, and that are arranged so that the first bulkhead section is positioned vertically above the second bulkhead section, wherein each of the first and second bulkhead sections includes a respective cavity that is configured to receive ballast, the bulkhead sections being capable of varying degrees of floatation or submerging depending upon amounts of the ballast that are received in the cavities; and first and second side assemblies that are respectively positioned adjacent to the first and second ends of the bulkhead assembly and that are configured respectively to span respective distances outward from the respective first and second ends so that the overall bulkhead system will extend fully between opposed side structures of a dam when implemented in relation thereto, wherein each of the side assemblies includes a respective first structural member that extends outward away from the bulkhead assembly from a respective first location along the respective end of the bulkhead assembly adjacent to which the respective side assembly is positioned, and also each of the side assemblies includes a respective brace member that extends outward away from a respective second location along the bulkhead assembly adjacent to which the respective side assembly is positioned, up to a respective further location along the respective first structural member of the respective side assembly, wherein the bulkhead system further includes a plurality of seal structures configured to establish a watertight or substantially watertight interfacing of the bulkhead system with respect to the dam when implemented in relation thereto, and wherein the respective brace members of the respective side assemblies include respective gusset structures, wherein the respective second locations are upstream of the respective first locations and are along the respective ends of the bulkhead assembly, and wherein the respective gusset structures extend outward away in a diagonal manner to the respective further locations along the respective first structural members.

2. The bulkhead system of claim 1, wherein respective support struts extend horizontally along each of the respective ends of the bulkhead assembly at the respective second locations, at respective vertical levels coincident with respective vertical levels of the respective gusset structures.

3. The bulkhead system of claim 1, wherein the respective side assemblies include respective portions that extend outward from respective third locations positioned inwardly of the first and second ends of the bulkhead assembly along a downstream side of the bulkhead assembly to the first and second ends, respectively.

4. The bulkhead system of claim 3, wherein the respective portions of each of the respective side assemblies include a respective primary portion that is coupled to the respective first structural member of the respective side assembly and that extends downstream of the respective first structural member alongside the respective end of the bulkhead assembly adjacent to which the respective side assembly is positioned, and wherein the respective portions of each of the respective side assemblies also include one or more additional members that extend inward from the respective primary portion along the downstream side of the bulkhead assembly.

5. The bulkhead system of claim 4, wherein each of the respective side assemblies also includes one or more further members that extend rearward from the respective primary portion, and wherein the bulkhead system further includes one or more rods that extend, rearward of the bulkhead assembly, between the further members of the first and second side assemblies.

6. The bulkhead system of claim 5, wherein each of the additional members and the further members includes a respective triangular formation.

7. The bulkhead system of claim 1, wherein each of the first structural members include a respective front wall, a respective rear wall, and a respective pair of connecting walls extending internally between the respective front and rear walls, wherein the respective front, rear, and connecting walls form an interior vertically-extending chamber.

8. The bulkhead system of claim 7, wherein each of the first structural members further includes a respective pair of vertically-extending side pockets, wherein a first of the side pockets of each respective pair is formed by the respective front and rear walls and a first of the respective pair of the connecting walls of the respective first structural member, and wherein a second of the side pockets of each respective pair is formed by the respective front and rear walls and a second of the respective pair of the connecting walls of the respective first structural member.

9. The bulkhead system of claim 8, wherein a respective plurality of stiffening plates are positioned at a respective plurality of vertical levels within each of the vertically-extending side pockets.

10. The bulkhead assembly of claim 7, wherein each of the first structural members is formed from a pair of I-beams that are welded to together.

11. The bulkhead system of claim 1, wherein the seal structures include at least first and second seal structures configured for the interfacing of the bulkhead system with respect to two piers of the dam, and further include at least one additional seal structure configured for the interfacing of the bulkhead system with respect to a sill or monolith of the dam.

12. The bulkhead system of claim 11, wherein the first and second seal structures are respectively mounted upon respective vertically-extending structures coupled respectively to the respective first support structures of the respective side assemblies.

13. The bulkhead system of claim 1, wherein each of the cavities is accessible from an exterior of the bulkhead sections by way of one or more orifices, so that the ballast can be pumped or otherwise provided into the cavities, and wherein two or more of the bulkhead sections and the side assemblies are coupled to one another by way of one or more fastening devices that are FLEXIFLOAT connector devices.

14. A method of implementing a bulkhead system in relation to a dam so as to prevent or limit a flow of water past the dam, the method comprising:

providing a plurality of bulkhead sections assembled together as a bulkhead assembly, wherein each of the bulkhead sections includes a respective internal cavity that is configured to receive a respective amount of ballast therewithin;

coupling first and second side assemblies to first and second ends of the bulkhead assembly so as to form the bulkhead system;

causing a first of the bulkhead sections to receive the respective amount of ballast therewithin;

receiving water pressure at an upstream surface of the bulkhead assembly such that the bulkhead system is forced against the dam and substantially sealed in relation thereto; and operating to counteract the water pressure and thereby prevent or limit the flow of water past the dam, wherein the operating is performed at least in part by one or more brace members of the side assemblies of the bulkhead system, wherein the one or more brace members include one or more of structural gussets extending diagonally outward from locations alongside ends of the bulkhead assembly to locations along structural support members of the side assemblies.

15. The method of claim 14, wherein the one or more brace members include formations extending inward along a downstream surface of the bulkhead assembly from the structural support members of the side assemblies.

16. The method of claim 14, further comprising rotating of the bulkhead assembly when the first of the bulkhead sections is caused to receive the respective amount of ballast therewithin.

17. The method of claim 16, further comprising positioning the bulkhead system at a desired location proximate the dam, wherein the positioning occurs one or more of before and after the rotating.

18. The method of claim 16, further comprising additionally causing a second of the bulkhead sections to receive the respective amount of the ballast therewithin, wherein the bulkhead assembly becomes submerged to an increased degree when the first and second of the bulkhead sections receive the respective amounts of the ballast, wherein the ballast is water, and wherein the causing and additionally causing is either performed by way of pumping or is performed by allowing the water to flow into the bulkhead sections due to gravity.

19. A method of implementing a bulkhead system in relation to a dam so as to prevent or limit a flow of water past the dam, the method comprising:

assembling a plurality of bulkhead sections together as a bulkhead assembly, wherein each of the bulkhead sections includes a respective internal cavity that is configured to receive a respective amount of ballast therewithin;

further assembling first and second side assemblies to first and second ends of the bulkhead assembly and to one another so as to form the bulkhead system, wherein the further assembling of the side assemblies to one another includes coupling the side assemblies by way of one or more rods;

causing a first of the bulkhead sections to receive the respective amount of ballast therewithin so as to result in tipping of the bulkhead assembly as the first bulkhead section becomes increasingly submerged relative to a remainder of the bulkhead assembly;

additionally causing a second of the bulkhead sections to receive the respective amount of ballast therewithin so as to result in further submerging of the bulkhead assembly;

receiving water pressure at an upstream surface of the bulkhead assembly such that the bulkhead system is forced against the dam and substantially sealed in relation thereto; and operating to counteract the water pressure and thereby prevent or limit the flow of water past the dam, wherein the operating is performed at least in part by one or more brace members of the side assemblies of the bulkhead system, wherein the one or more brace members include one or more of structural gussets extending diagonally outward from locations alongside ends of the bulkhead assembly to locations along structural support members of the side assemblies.

20. The method of claim 19, further comprising:

floating the bulkhead system to a first location proximate the dam; and adjusting a position of the bulkhead system relative to the dam, wherein the adjusting occurs at a time subsequent to the floating.

* * * * *